US005964176A

United States Patent [19]

Grunau et al.

[11] Patent Number: 5,964,176

[45] Date of Patent: Oct. 12, 1999

[54] INFLATABLE KEEL

[75] Inventors: William C. Grunau, Yorba Linda; Douglas A. R. Batson, Norco, both of Calif.

[73] Assignee: WETCO, L.L.C., Yorba Linda, Calif.

[21] Appl. No.: 09/041,288

[22] Filed: Mar. 12, 1998

[51] Int. Cl.[6] ..... B63B 7/00

[52] U.S. Cl. ..... 114/345; 114/140

[58] Field of Search ..... 114/345, 253, 114/140; 441/40, 80

[56] References Cited

U.S. PATENT DOCUMENTS

| | | | |
|---|---|---|---|
| 2,370,069 | 2/1945 | Patten | 114/345 |
| 4,603,651 | 8/1986 | Harding | 114/345 |
| 4,640,217 | 2/1987 | Ferronniere | 114/345 |
| 4,722,292 | 2/1988 | Marino et al. | 114/345 |
| 5,354,222 | 10/1994 | Elias | 441/80 |

*Primary Examiner*—Stephen Avila
*Attorney, Agent, or Firm*—Robert D. Fish; Crockett & Fish

[57] ABSTRACT

Methods and devices are provided for a water craft, for use on a body of water, having a bottom, and an inflatable keel, coupled to the bottom, wherein the keel contacts the surface of the water during operation of the craft, the keel comprising an inflatable bladder wherein inflating the bladder results in the keel at least partially transitioning from a collapsed state to an inflated state.

10 Claims, 1 Drawing Sheet

FIG. 1
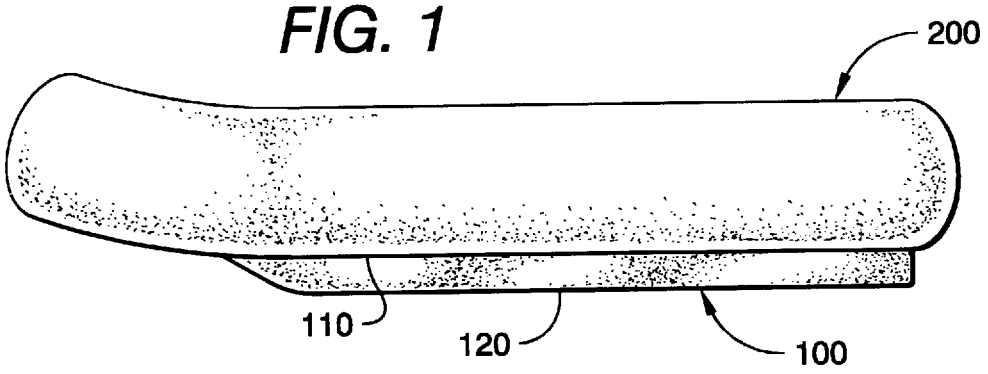
FIG. 2
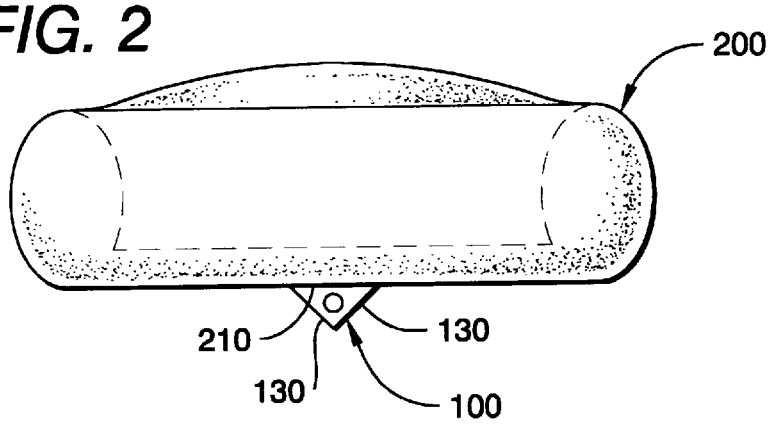
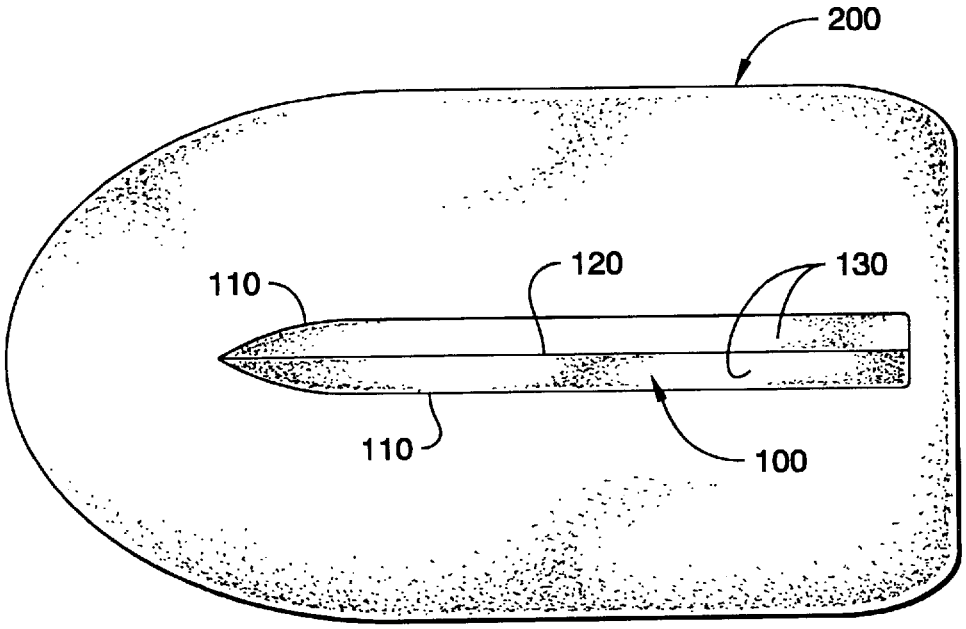
FIG. 3

INFLATABLE KEEL

FIELD OF THE INVENTION

The field of the invention is water craft.

BACKGROUND OF THE INVENTION

Water craft of various types have been used for centuries. For some types of watercraft, such as inflatable boats and rafts, portability and ease of storage are primary factors to be considered when designing the craft. One way of improving portability and ease of storage is to reduce the overall size and weight of the craft. Reduction of the overall size and weight can generally be accomplished by reduction in the size and weight of the various components or members of the craft.

One member which is common to many boats is a keel. For many water craft the purpose of the keel is to act as a primary structural support. Another purpose, in many craft, is to provide stability by making it more difficult for the craft to be pushed "sideways" to the line of travel, thus making it easier to propel the craft in a straight line, and to provide a countering force. Additionally, the keel in many craft is used to shift the center of gravity downward to increase the probability that the craft will remain upright. Thus, keels are frequently designed to be rigid, heavy, or both rigid and heavy. Providing a craft with a keel which is rigid or heavy tends to make it less portable and more difficult to store.

When designing water craft, it is generally desirable to reduce drag so that less energy is required to accelerate the craft to some velocity, and to maintain that velocity once it has been reached. Inflatable rafts frequently have flat bottoms to reduce drag at lower speeds and to permit hydroplaning at higher speeds. If the raft is self-propelled, hydroplaning at higher speeds is generally desirable. However, if the raft is being towed, the tendency to hydroplane is less desirable as it frequently results in instability with the raft bouncing about and wandering back and forth in the wake of the craft which is towing the raft.

Inflatable craft are frequently designed to be both portable and easily storable. As such, it is generally undesirable to provide such a craft with a rigid or heavy keel. As a result, various alternatives have been tried.

One such alternative is the use of fins, center boards, dagger board, and outriggers (see U.S. Pat. Nos. 3,577,576 to Lobb (May 4, 1971), 4,249,276 to Snyderman (Feb. 10, 1981), and 4,735,163 to Filshie (Apr. 5, 1988)). However, such devices are not completely satisfactory as their use requires providing a means for mounting them to the craft, thus increasing the cost of the craft, and increasing the time required for setting up the craft. Additionally, being rigid and having more weight than the inflatable portions of the craft, they tend to decrease portability and ease of storage. Portability and ease of storage is also decreased because of the increased number of parts.

Another alternative to providing a rigid and heavy keel is to modify the bottom or hull of the craft into a 'V' shape. This alternative is generally used with craft having substantially rigid bottoms. As an example, U.S. Pat. No. 3,694,836 discusses a collapsible boat having a substantially rigid buoyant bottom. However, because of the substantially rigid bottom, the craft, even when collapsed, occupies at least as much space as the bottom. Another example having a similar problem is U.S. Pat. No. 4,858,550 which discusses the use of a hard shell shaped to cover the bottom of an inflatable craft and made from various contoured staves or segments joined together. Although there is less of a problem in regard to size as the segments can be separated, the individual segments are still of a size and weight to limit portability and ease of storage. Also, as with the use of devices such as dagger boards, there are more items to maintain, increased cost, and increased setup time.

For craft having a bottom comprising a hard, flat, and rigid surface covered by a more watertight, flexible material, hull shape modification can be accomplished using a cylindrical, inflatable member between the rigid bottom and the flexible sheet. U.S. Pat. Nos. 4,640,217 to Ferronmiere (Feb. 3, 1987) and 4,603,651 to Harding (Aug. 5, 1986) discuss craft having such members. Two of the primary problems with these designs are that (1) the 'V' shape of the hull tends to be relatively flat and to have a rounded bottom, thus decreasing the ability to cut into the surface of the water and prevent hydroplaning, and (2) a hard, flat, and rigid bottom is required to provide the support required for the hull to maintain its shape. The shaped hulls of Ferronmiere '217 and Harding '651 don't comprise an "inflatable keel" as the term is used herein in that the hulls themselves are not inflatable, the inflatable members used to modify the shape of the hulls don't contact the water, and a rigid bottom is required in conjunction with the inflatable member to properly shape the hull.

Thus there is a continuing need for improvements in the design of water craft.

SUMMARY OF THE INVENTION

Methods and devices are provided for a water craft, for use on a body of water, having a bottom, and an inflatable keel, coupled to the bottom, wherein the keel contacts the surface of the water during operation of the craft, the keel comprising an inflatable bladder wherein inflating the bladder results in the keel at least partially transitioning from a collapsed state to an inflated state.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1 is a side view of a first inflatable keel embodying the invention.

FIG. 2 is a rear view of the inflatable keel of FIG. 1.

FIG. 3 is a bottom view of the inflatable keel of FIG. 1.

DETAILED DESCRIPTION

Referring first to FIG. 1, an inflatable keel 100 is attached to an inflatable raft 200. When viewed from the side, the top edges 110 of the keel 100 conform to the shape of the bottom of raft 200. The bottom edge 120 of the keel 100 is essentially flat for the majority of its length, but the front of the keel slopes up to meet the bottom of the raft. Referring to FIG. 2, keel 100 forms a triangular shape when viewed from the rear, with the raft bottom 210 forming the base of the triangle, and the sides 130 of the keel forming the sides of the triangle, and the water contacting surface of the keel. The water contacting surface is the portion of the keel which is in contact with water during normal operation of the craft. The line formed by the intersection of the two sides of the keel 100 can be referred to as the keel's center line. Referring to FIG. 3, keel 100, when viewed from the bottom, has a torpedo-like shape in that the rear portion of the keel

100 is roughly rectangular, but the forward part of the keel 100 narrows to form a point in line with the keel's center line.

In a preferred embodiment, several pieces of air and water tight material are pieced together to form the sides and bottom of the keel. The sides of the keel are then electrically welded to the bottom of the craft such that the keel and craft together form an air and water tight bladder. During the process of piecing together and attaching the keel, a mechanism such as a valve is incorporated into the keel so that the keel can be inflated once it has been attached to the craft. Although is preferred to inflate the keel by filling the keel with air, other alternatives such as the use of a fluid or fluidic substance are also contemplated. As an example, if it were desired that additional weight and/or mass be added to the keel, the keel could be "inflated" by filling the keel with water. Similarly, if a more rigid keel were desired, the keel might be filled with a foam which would initially be fluidic, but would harden over time to form a rigid keel.

Although the figures show a keel containing only a single bladder which is formed by the sides of the keel, other variations such as the use of multiple bladders are also contemplated. It is also contemplated that, regardless of whether a single bladder or multiple bladders are used, the keel would completely enclose the bladder or bladders such that the bottom of the craft to which the keel is attached would not provide any structure to the bladders.

For a keel which does not depend on the bottom of the craft for providing structure to the bladder or bladders, the keel could be detachable such that the craft could be operated with or without the keel.

The keel shown is triangular in shape when viewed from the front or the rear. However, other shapes are also contemplated, such as cylindrical shapes and rectangular or other polygonal shapes. Additionally, the keel shown has an overall width much narrower than that of the craft to which it is attached and is shorter than the bottom of the craft to which it is attached. However, it is contemplated that other widths or lengths might be used such as extending the overall length of the keel up to or beyond the length of the craft, and extending the overall width of the keel up to or beyond the width of the craft.

The keel shown in the figures is made from pieces of plastic. However, any material capable of being formed into the desired shape upon inflation could be used.

Thus, specific embodiments and applications of an inflatable keel have been disclosed. It should be apparent, however, to those skilled in the art that many more modifications besides those already described are possible without departing from the inventive concepts herein. For example, the keel could sewn or glued onto the bottom of the craft rather than electrically welded. Similarly, it is possible to use the keel herein described with non-inflatable as well as inflatable craft. The inventive subject matter, therefore, is not to be restricted except in the spirit of the appended claims.

What is claimed is:

1. A water craft for use on a body of water having a bottom, and an inflatable keel, coupled to the bottom, the keel comprising an inflatable bladder wherein the bladder, when inflated, has an at least roughly triangular shape comprising a base and two sides, wherein the base of the triangle comprises a portion of the bottom of the craft, and at least portions of the sides of the triangle contact the surface of the water during operation of the craft, and inflation of the bladder results in the keel substantially transitioning from a collapsed state to an inflated state.

2. The water craft claim 1 wherein inflation of the bladder results from at least partially filling the bladder with a fluid.

3. The water craft of claim 1 wherein the keel is electrically welded to the bottom of the water craft.

4. The water craft of claim 3 wherein the water craft is an inflatable raft having a non-rigid bottom.

5. The water craft of claim 1 wherein the keel has a length essentially equal to the length of the craft.

6. The water craft of claim 1 wherein the keel has a width essentially equal to the width of the craft.

7. The water craft of claim 1 wherein the keel can transition from the inflated state to the collapsed state.

8. The water craft of claim 1 wherein the keel is detachable from the water craft.

9. A method of towing the craft of claim 1, said method comprising providing an inflatable raft, coupling the raft to a second water craft and using the second water craft to propel the raft.

10. The method of claim 9 further comprising providing an item to be transported, placing the item to be transported into the raft, and towing the raft across the body of water.

* * * * *